US008162631B2

(12) United States Patent
Patel et al.

(10) Patent No.: US 8,162,631 B2
(45) Date of Patent: Apr. 24, 2012

(54) FLOATING PINION BEARING FOR A RECIPROCATING PUMP

(75) Inventors: Pankaj H. Patel, Keller, TX (US); Mark D. Matzner, Burleson, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 775 days.

(21) Appl. No.: 12/277,849

(22) Filed: Nov. 25, 2008

(65) Prior Publication Data

US 2010/0129245 A1 May 27, 2010

(51) Int. Cl.
*A61M 1/00* (2006.01)
*F04B 19/24* (2006.01)

(52) U.S. Cl. ..... 417/437; 417/572

(58) Field of Classification Search ..... 417/437, 417/572; 92/58.1; 239/525, 526, 530
See application file for complete search history.

(56) References Cited

U.S. PATENT DOCUMENTS

| | | | |
|---|---|---|---|
| 4,512,694 | A | 4/1985 | Foran et al. |
| 4,824,342 | A | 4/1989 | Buck |
| 5,078,580 | A | 1/1992 | Miller et al. |
| 7,364,412 | B2 | 4/2008 | Kugelev et al. |
| 7,374,005 | B2 | 5/2008 | Gray, Jr. |
| 2007/0041847 | A1 | 2/2007 | Inoue et al. |
| 2007/0099746 | A1 | 5/2007 | Hahlbeck |
| 2008/0213115 | A1 | 9/2008 | Hilger et al. |

FOREIGN PATENT DOCUMENTS

| | | |
|---|---|---|
| EP | 0300905 A1 | 1/1989 |
| GB | 2342421 B | 3/2003 |

*Primary Examiner* — Joseph L Williams
(74) *Attorney, Agent, or Firm* — Bracewell & Giuliani LLP

(57) ABSTRACT

A reciprocating pump assembly includes a power frame that houses a crankshaft. The crankshaft is mechanically connected to a large gear or bull gear on each end that is in mechanical engagement with a small gear or pinion bearing. A bearing housing is integrally formed as part of the power frame with an increased width and a constant inner diameter. A pinion bearing assembly, having an inner race, an outer race, and spherical bearings is placed around the shaft of the pinion bearing. The pinion is installed in the reciprocating pump assembly such that the bearing assembly rests on the bearing housing, which is integrally formed as part of the power frame. The bearing assembly is free to float in the bearing housing and provides for some lateral movement of the shaft and bearing assembly during operation of the reciprocating pump assembly.

14 Claims, 4 Drawing Sheets

FLOATING PINION BEARING FOR A RECIPROCATING PUMP

FIELD OF THE INVENTION

The present invention relates in general to reciprocating pumps and, particular, to a floating pinion bearing for a reciprocating pump.

BACKGROUND OF THE INVENTION

In oil field operations, reciprocating pumps are often used for various purposes. Some reciprocating pumps, generally known as "service pumps," are typically used for operations such as cementing, acidizing, or fracing a well. Typically, these service pumps run for relatively short periods of time, but they operate on a frequent basis. Often they are mounted to a truck or a skid for transport to various well sites. A pump might operate several times a week. In many applications, several pumps are connected in parallel to a single flow line.

Referring to FIG. 1, a reciprocating pump assembly or pump 11 includes a crankshaft housing or power frame housing 13 that comprises a majority of the outer surface of reciprocating pump 12. A plunger or plunger rod housing 15 attaches to an end of power frame housing 13 and extends to a set of cylinders 17. A portion of reciprocating pump 12 housed within power frame housing 13 is shown. Power frame housing 13 houses a crankshaft 25, which is typically mechanically connected to a motor (not shown). The motor rotates crankshaft 25 in order to drive reciprocating pump 12. In one embodiment, crankshaft 25 is cammed so that fluid is pumped from each cylinder 17 at alternating times. As is readily appreciable by those skilled in the art, alternating the cycles of pumping fluid from each of cylinders 17 helps minimize the primary, secondary, and tertiary (et al.) forces associated with reciprocating pump 12. In one embodiment, a large main gear or bull gear 24 is mechanically connected to each end of crankshaft 25. A small gear or pinion 26 is in mechanical engagement with each bull gear 24. A motor (not shown) couples to a splined end 29 of pinion shaft 27 (FIG. 2). The gear teeth on pinion 26 on each end are helical or inclined relative to the axis of pinion shaft 27. The inclination of the teeth on one pinion 26 is opposite that on the other. Bull gears 24 are rotated by the motor through the mechanical engagement of bull gears 24 and pinions 26.

As shown in FIGS. 1 through 3, reciprocating pump assembly 11 has a large gear or bull gear 24 one each side, and a smaller gear or pinion 26 in mechanical engagement with one another. Each bull gear 24 is mechanically connected to a crankshaft 25. Gear sections of pinion 26 are located at opposite ends of the pinion shaft 27, with a splined end 29 extending from one end of shaft 27. Shaft 27 passes through the power frame housing 13 of the reciprocating pump assembly 11.

Near each end of shaft 27, a pinion bearing assembly 31 comprising an inner race 33, an outer race 35, and spherical bearings 37 is shrunk-fit around a desired portion of pinion shaft 27. Although referred to as "spherical," bearings 37 are generally cylindrical, but with outward curved sides between its ends. A bearing housing 39 fits around the outer race 35 of bearing assembly 31. Bearing housing 39 contains a lip 43 around its outer surface that acts to capture bearing assembly 31 once bearing housing 39 is securely fastened to power frame housing 13. Bearing housing 39 is bolted to a frame housing 40 by bolts 42. Frame housing 40 is welded to power frame housing 13. An outer housing surrounds gears 24, 26 and is filled with a lubricating fluid.

Assembly and installation of the pinion 26, and in particular, the bearing housing 39 to power frame 13 requires hammering of the bearing housings 39 into the power frame 13. While doing so, bearing housing 39 may become misaligned with bearings 37. The installation process is time consuming and inefficient. Thus, an improved design for facilitating engagement between the various components of reciprocating pump assemblies is needed.

SUMMARY OF THE INVENTION

One embodiment of a floating pinion bearing for a reciprocating pump assembly includes a power frame that houses a crankshaft. The crankshaft is mechanically connected to a large gear or bull gear on each end that is in mechanical engagement with a small gear or pinion. A bearing housing is integrally formed as part of the power frame with an increased width and a constant inner diameter. A pinion bearing assembly comprising an inner race, an outer race, and spherical bearings is placed around the shaft of the pinion. A sleeve with a flange area is placed around the shaft and is placed in flush contact with the inner and outer races of the bearing assembly before being temporarily secured to the shaft. The pinion is installed in the reciprocating pump assembly such that the bearing assembly rests on the bearing housing which is integrally formed as part of the power frame. The sleeve is then removed from the shaft. The bearing assembly is free to float on the bearing housing and provides for some lateral movement of the shaft and bearing assembly during operation of the reciprocating pump assembly. The bull gears on opposite ends have helical teeth aligned opposite each other. The teeth create resultant forces on the pinion teeth to maintain it centered.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
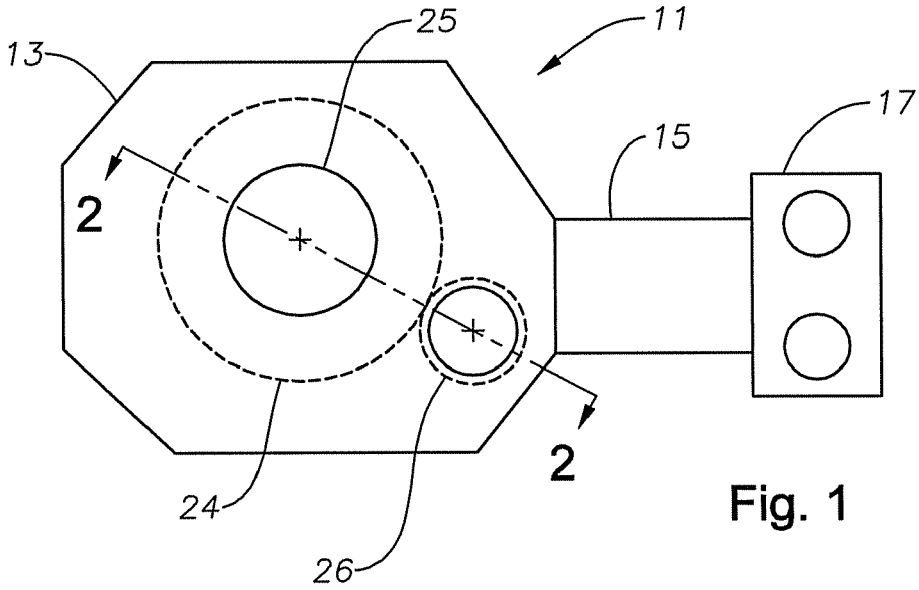
FIG. 1 is an elevational view of a reciprocating pump assembly as known in the prior art.
Figure 2:
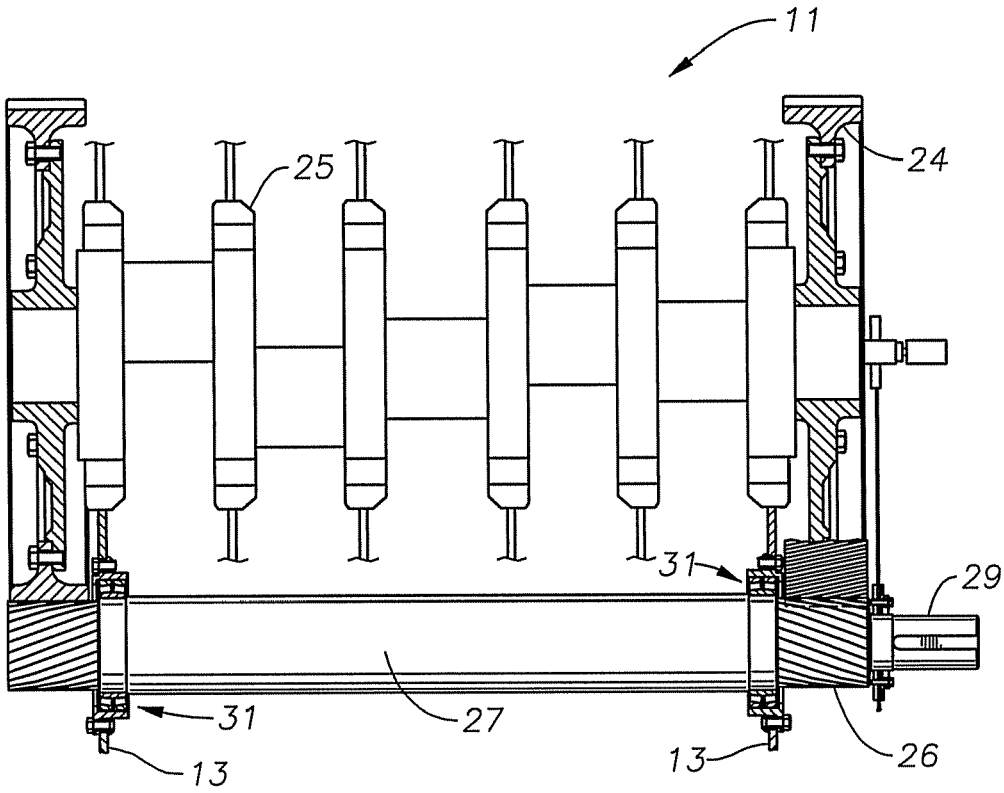
Fig. 2 (Prior Art)
FIG. 2 is a sectional view of a the reciprocating pump assembly and is taken along the line 2-2 of FIG. 1.
Figure 3:
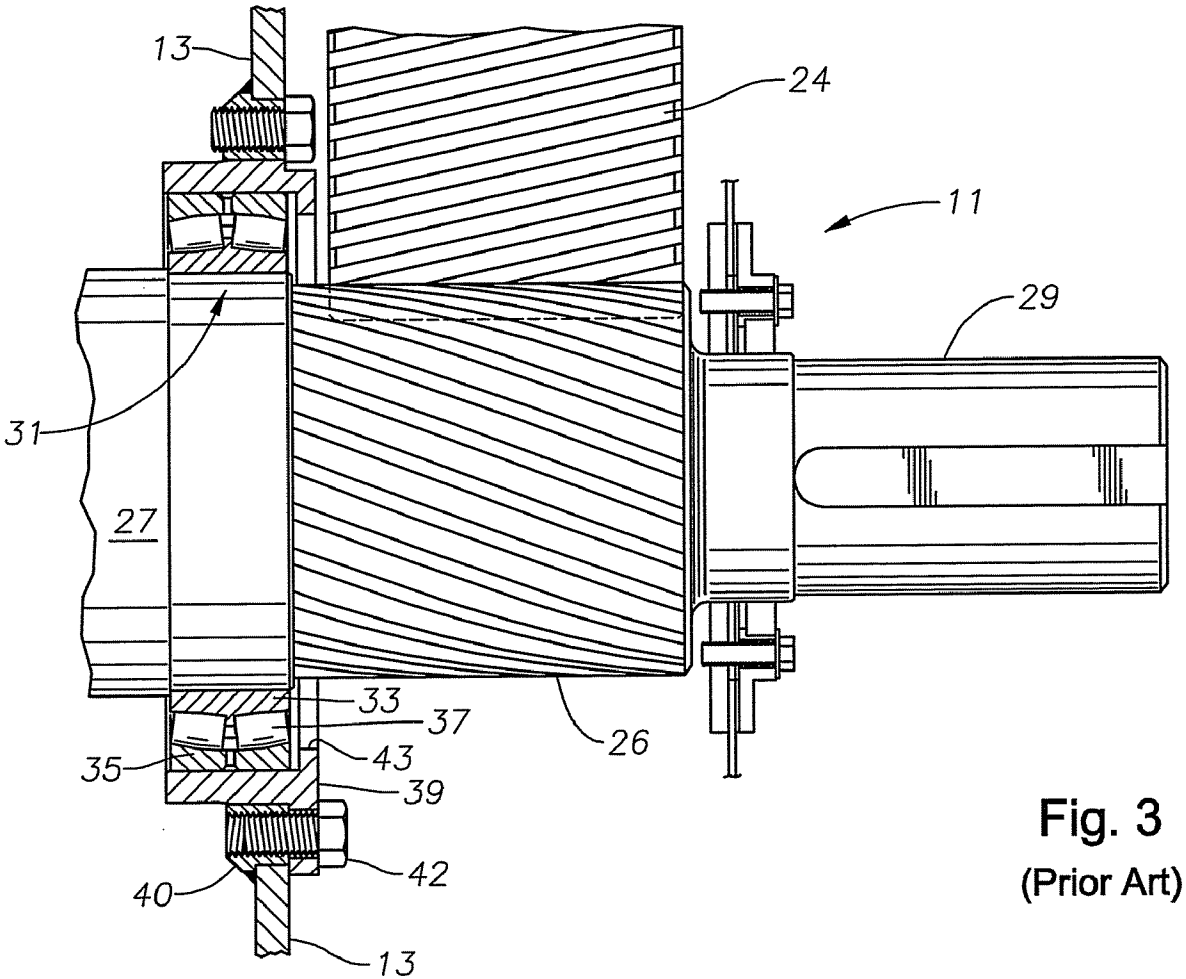
Fig. 3 (Prior Art)
FIG. 3 is an enlarged view of a portion of the pump assembly shown in FIG. 2.
Figure 4:
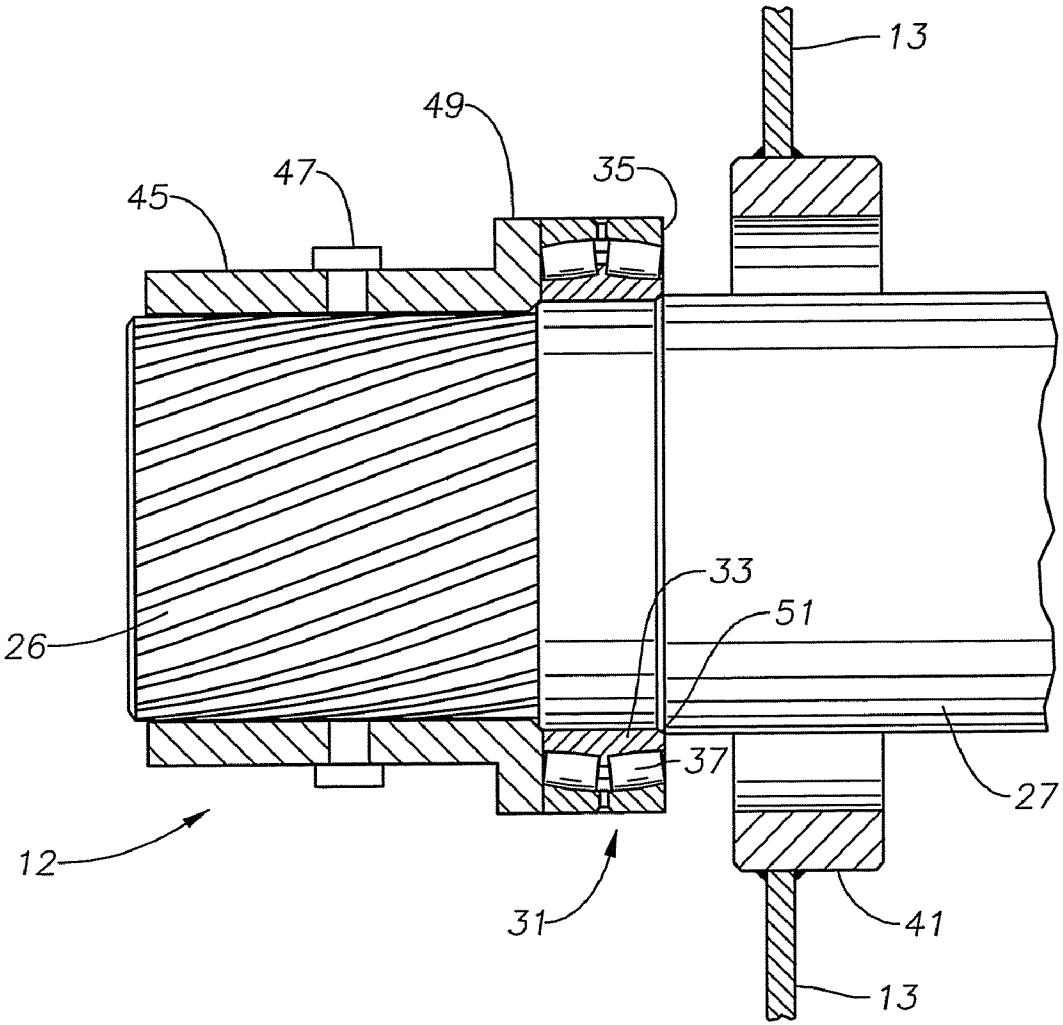
FIG. 4 is a sectional view of a reciprocating pump assembly constructed in accordance with the present invention, prior to installation of the pinion bearing assembly within the power frame housing.

Pump 12 of this invention has the same general components as described in connection with FIGS. 1-3, including power frame housing 13, crankshaft 25, bull gears 24, and pinions 26 on each end of a pinion shaft 27. The pinion bearing assembly 31 is also the same, having an inner race 33, an outer race 35, and spherical bearings 37. Although referred to as "spherical," bearings 37 are generally cylindrical, but with outward curved sides between its ends. Referring to FIG. 4, a bearing housing 41 is preferably formed separate from power frame housing 13 and securely fastened to power frame housing 13, as by welding. Bearing housing 41 is a cylindrical sleeve with a width greater than that of outer race 35 of pinion bearing assembly 31. The width of bearing housing 41 is also greater than the wall thickness of power frame housing 13 in this example. Inner race 33 is shrunk-fit onto pinion shaft 27.

An installation tool or sleeve 45 is used to install pinion 26 and pinion bearing assembly 31. Sleeve 45 contains a plurality of set screws 47 that extend through the sleeve and engage the teeth on pinion 26 in order to secure the position of sleeve 45 around pinion 26. Sleeve 45 has a flange area 49 on one of its ends. Flange area 49 has an outer diameter preferably equal to or greater than that of the outer race 35 outer diameter.

Figure 5:
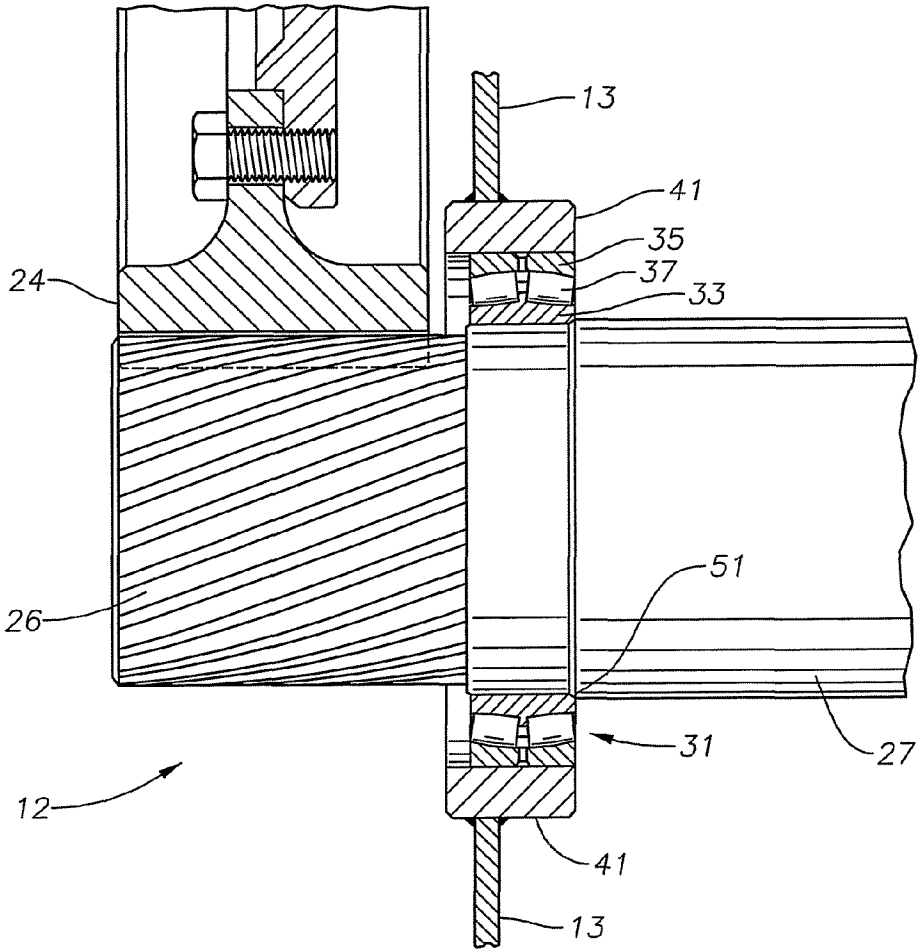
FIG. 5 is a sectional view of a reciprocating pump assembly constructed in a accordance with the present invention with the pinion bearing assembly installed within the power frame housing.

Referring to FIGS. 4 and 5, during installation of the pinion 26 and pinion bearing assembly 31 into power frame housing 13, inner race 33 of pinion bearing assembly 31 is heated and then placed around a desired portion of pinion shaft 27 on each end of pinion shaft 27. Inner race 33 becomes fixed to pinion shaft 27 and engages a shoulder 51 on each end of pinion shaft 27. Sleeves 45 are placed around each end of pinion shaft 27 and positioned such that flange 49 is in flush contact with inner race 33 and outer race 35. Set screws 47 are tightened against pinion 26 to maintain the position of the sleeve 45. Sleeves 45 ensure that inner races 33 and outer races 35 are in proper alignment throughout the installation process. Grease is placed on each bearing housing 41. Pinion 26 and shaft 27 are inserted through power frame housing 13. The outer diameter of sleeves 45, including set screws 47, is less than the inner diameter of bearing housing 41, so that one of the sleeves 45 passes through both bearing houses 41. Pinion 26 is inserted into power frame housing 13 until each pinion bearing assembly 31 is located in bearing housing 41. Some tapping of pinion shaft 27 may be required. Once pinion bearing assembly 31 is in its proper position within bearing housing 41, set screws 47 are loosened, and each sleeve 45 is removed from pinions 26. Bull gears 24 are then installed in mechanical engagement with pinions 26. An outer housing surrounds gears 24, 26 and is filled with a lubricating fluid.

During operation of the reciprocating pump assembly 12, bull gears 24 do not move laterally, but pinion shaft 27 is free to float or move laterally. Bearing assemblies 31 are fixed to pinion shaft 27 and float with it. The pinion bearing assemblies 31 are free to float axially or laterally on bearing housings 41. During operation, bearing assemblies 31 thus move laterally in unison with pinion 26 and shaft 27. The engagement of bull gears 24 and pinions 26 prevents pinion bearing assembly 31 from leaving the bearing housing 41, as the maximum axial movement allowed in one embodiment is 0.250 inches, but that maximum may be varied.

The invention has several advantages. By eliminating the outer bearing housing, the installation time of the pinion and pinion bearing assembly is reduced. Additionally, the incorporation of the bearing housing as an integral part of the power frame housing helps to transfer the load from the pinion to the power frame as the complete width of the bearing and power frame are in contact at all times.

While the invention has been shown or described in only some of its forms, it should be apparent to those skilled in the art that it is not so limited, but is susceptible to various changes without departing from the scope of the invention.

What is claimed is:

1. A reciprocating pump assembly, comprising:
- a power frame housing that houses a crankshaft;
- a pinion shaft having opposite ends extending through apertures in opposite sides of the power frame housing;
- a main gear mechanically connected to each end of the crankshaft;
- a pinion gear on each end of the pinion shaft, in mechanical engagement with one of the main gears; and
- a bearing assembly placed around a portion of the pinion shaft and in contact with each of the apertures, each of the bearing assemblies and the pinion shaft being free to move axially along an axis of the pinion shaft in unison with each other a limited amount relative to the main gears.

2. The reciprocating pump assembly of claim 1, wherein the bearing assembly comprises an inner race, an outer race, and roller bearings located there between.

3. The reciprocating pump assembly of claim 1, wherein a width of the aperture is at least as wide as the bearing assembly.

4. The reciprocating pump assembly of claim 1, wherein each of the apertures comprises:
- a bearing housing that is welded to the power frame housing; and
- each of the bearing assemblies comprises an outer race in engagement with an inner diameter surface of the bearing housing.

5. The reciprocating pump assembly of claim 1, wherein each of the apertures comprises:
- a bearing housing that is sationarily mounted the power frame housing; and
- each of the bearing assemblies comprises an outer race in engagement with an inner diameter surface of the bearing housing, wherein the outer race is slidable relative to the bearing housing.

6. The reciprocating pump assembly of claim 1, wherein each of the pinion gears has teeth inclined relative to an axis, and wherein the inclination on one of the pinion gears is opposite direction to the other so as to balance the axial forces on the pinion shaft.

7. The reciprocating pump assembly of claim 1, further comprising a bearing housing with constant cylindrical inner diameter from one side to the other, so as to be free of any lip.

8. A reciprocating pump assembly, comprising:
- a power frame housing that houses a crankshaft;
- a bearing housing that is stationarily mounted the power frame housing;
- a pinion shaft having opposite ends extending through the bearing housing in opposite sides of the power frame housing;
- a main gear mechanically connected to each end of the crankshaft;
- a pinion gear on each end of the pinion shaft, in mechanical engagement with one of the main gears, each of the pinion gears having teeth inclined relative to an axis, and wherein the inclination on one of the pinion gears is opposite direction to the other so as to balance the axial forces on the pinion shaft; and
- a bearing assembly placed around a portion of the pinion shaft and in contact with the bearing housing, the pinion shaft being free to move axially along an axis of the pinion shaft in unison with the bearing assemblies a limited amount relative to the main gears, wherein each of the bearing assemblies comprises an outer race in engagement with an inner diameter surface of the bearing housing, wherein the outer race is slidable relative to the bearing housing.

9. The reciprocating pump assembly of claim 8, wherein a width of the bearing housing is at least as wide as the bearing assembly and the bearing housing is welded to the power frame housing.

10. A. method of installing a pinion bearing assembly in a reciprocating pump assembly having aligned first and second apertures on opposite sides of a power frame housing comprising:

(a) securing first and second pinion bearing assemblies around first and seconds ends of a pinion shaft;

(b) placing first and second sleeves around the first and second ends of the pinion shaft and in contact with the first and second bearing assemblies, and securing its position;

(c) inserting the second sleeve and the second end of the pinion shaft into the first aperture on the power frame housing;

(d) extending the pinion shall through the second aperture of the housing until the first bearing assembly is seated in the first aperture and the second bearing is seated in the second aperture; and (e) removing the sleeves from the pinion shaft.

11. The method of claim 10, wherein step (a) comprises heating inner races of the pinion bearing assemblies before placing them around the shaft.

12. The method of claim 10, wherein step (b) further comprises tightening a plurality of set screws that extend through the sleeves such that they engage gear teeth on the shaft.

13. The method of claim 10, wherein each aperture contains a bearing housing rigidly attached to the power frame housing and the outer races. of the bearing assemblies slidingly engage the bearing housing.

14. The method of claim 10, further comprising welding a bearing housing to each of the apertures.

* * * * *